US005307717A

United States Patent [19]

Winston

[11] Patent Number: 5,307,717

[45] Date of Patent: May 3, 1994

[54] DISPENSING CARRIER AND CUTTING GUIDE FOR PLASTIC SHEETING

[76] Inventor: Paul Winston, 9401 E. Chenango, Englewood, Colo. 80111

[21] Appl. No.: 948,433

[22] Filed: Sep. 21, 1992

[51] Int. Cl.[5] ..... B26D 7/28

[52] U.S. Cl. ..... 83/649; 83/614; 83/522.11; 30/124

[58] Field of Search ..... 83/614, 649, 522.11, 83/522.19, 522.26; 30/124; 225/18, 41; 242/55.53; 7/163, 164

[56] References Cited

U.S. PATENT DOCUMENTS

| | | | |
|---|---|---|---|
| 2,393,384 | 1/1946 | Kress | 83/614 |
| 2,747,625 | 5/1956 | Small | 83/468 |
| 3,090,271 | 5/1963 | Castelli | 83/614 |
| 3,142,217 | 7/1964 | Busse | 83/649 X |
| 3,358,540 | 12/1967 | Hall | 83/649 X |
| 3,524,373 | 8/1970 | Helmus, Jr. et al. | 83/614 X |
| 4,294,389 | 10/1981 | Falk et al. | 225/41 X |
| 4,817,483 | 4/1989 | Armbruster | 83/649 X |
| 5,025,692 | 6/1991 | Reynolds | 83/614 X |

*Primary Examiner*—Eugenia Jones

[57] ABSTRACT

An improved appliance and dispensing container for common plastic sheeting roll goods of all sizes and types. The rectangular container is provided with an removable end-cap, and has a pay-out aperture located above the base plate. The container is of sheet metal or plastic construction. A flat base-plate extends outwardly from the dispenser and is provided with a parallel "knife groove" or slot. A common construction tape-measure is removable, mounted to an end-cap, for convenient measure of roll-good payout length. A handle is affixed to the top panel of the dispenser, and a compartment for knife or scissors is provided.

2 Claims, 3 Drawing Sheets

DISPENSING CARRIER AND CUTTING GUIDE FOR PLASTIC SHEETING

BACKGROUND OF THE INVENTION

1. Field of the Invention

This invention relates to a durable, convenient and reliable means for the secure containment, dispensing and measure of wide, plastic roll-goods of differing lengths and widths, primarily for use in the construction trades. When properly utilized, the present invention allows tradespeople to quickly and accurately mask-off large areas of a site, desired to be protected from painter other over-spray damage, utilizing the more durable wide plastic sheeting for this purpose. Additionally, the dispenser allows for a convenient and secure residence for a tape measure and a knife or scissor tool, and further permits visual inspection of the amount of roll goods remaining inside the dispenser without the need of opening it.

2. Description of the Prior Art

During construction of buildings and such, it is desirous for a tradesperson to quickly "mask-off" areas of the site, to help protect from "overspray" of paint or other materials. Additionally, during remodeling, it is desirous to protect and mask off furnishings and finished areas from dust infiltration and overspray, to provide for a clean, safe and well defined work.

To this end, a variety of masking devices have been developed to address this need. One type of such device is marketed in the U.S. as the "Scotch Hand Masker," which carries U.S. Pat. No. 3,587,557 and 3,950,214, and requires the use of roll paper goods, and can accommodate various widths and relatively short lengths of roll paper goods. The "Hand Masker" is a hand-held device which is cumbersome and prone to breakage during hard use in the trades, and requires a tradesman to apply multiple layers of masking paper to completely cover a large area, such as a sliding glass door. In practice, when paint or texture overspray resides on the paper masking, the masking paper becomes soggy and will not reliably permit a second coat without a lengthy wait, without "re-masking" the area.

Today, many plastic roll goods are packaged in durable cardboard containers. However, the cardboard containers provide no means for dispensing and measuring the roll goods contained therein.

Accordingly, these devices are generally unsatisfactory and relatively time consuming as reliable dispensers of wide plastic sheeting.

Other prior art devices which contain and dispense plastic roll goods are those as presented in U.S. Pat. No. 4,850,486 and 4,714,191. These devices which contain and dispense plastic trash bags and the like offer a convenient storage and dispensing means for pre-perforated plastic trashbags.

Further prior art roll good dispensers are embodied by tissue container, U.S. Pat. No. 4,936,452; and magazine for dispensing light-sensitive (plastic) materials, both of which provide pay-out aperture, as is found in U.S. Pat. Nos. 4,821,876, 5,053,795, and 5,038,934.

These devices which contain and dispense plastic roll material are all suitable for the utility upon which they received a patent, but none provide for a reliable and accurate measuring means. Presently there are no products which are designed to allow for a combination of storage, carrying, dispensing of various widths, and which provide a cutting surface in conjunction with a measuring means for the plastic roll good sheeting, to be used primarily as masking for the construction industry, all of which are address by the present invention in an easy-to-use package, as previously disclosed to the Office in the Disclosure Document program, Ser. No. 270,207.

SUMMARY OF THE INVENTION

A novel and useful appliance for containment, transport, field dispensation and measure of plastic roll sheeting is provided by the present invention. The dispenser is conveniently re-filled with rolls of plastic sheeting of various widths, and has a pay-out aperture through which the sheet goods are dispensed. Being of metal, wood, or plastic construction, the dispenser has a carrying handle located upon the upper face, and it is provided with a means to secure a tape measure to an end of the dispenser, to allow for measure of dispensed plastic sheeting. Further, the dispensing appliance is provided with a substantial, flat base plate which adds stability to the dispenser and allows for the provision of a straight knife or scissors groove to facilitate a straight, even cut-off of the dispensed roll goods. Additionally, the leading edge of the base plate serves as a straight-edge for further marking or cutting ability.

In view of the above, it is a primary objective of the present invention to provide a durable and convenient means for transporting and securely containing sheet plastic roll goods, which is easily carried.

It is also an objective of the invention to provide a tradesperson with a convenient and reliable means of dispensing sheet plastic roll goods.

It is another object of the invention to provide for a carrier which will accept differing widths and lengths of rolls of sheet plastic.

An additional object of this invention is to provide a construction tradesperson with a reliable means to field measure the length of plastic sheeting dispensed from the carrier, by utilizing a removeably attached tape measure.

Another object of the present invention is to provide a carrier for dispensing sheet plastic roll goods, which provides for securely holding a tape measure and additionally holds a scissors tool or knife, adjacently, for quick access.

It is a further object of the invention to provide for a flat base plate, which projects outwardly from the base of the dispenser, and this base plate serves as both a cutting guide and straight-edge for the cutting off of the measured plastic roll goods.

Yet another object of the invention is to provide for a carrier/dispenser for plastic roll sheeting that has a removable end cap, which is provided with a slot perforation through it, or "sight gauge," to allow for visual roll good remainder recognition.

DESCRIPTION OF THE PREFERRED EMBODIMENT

Figure 1:
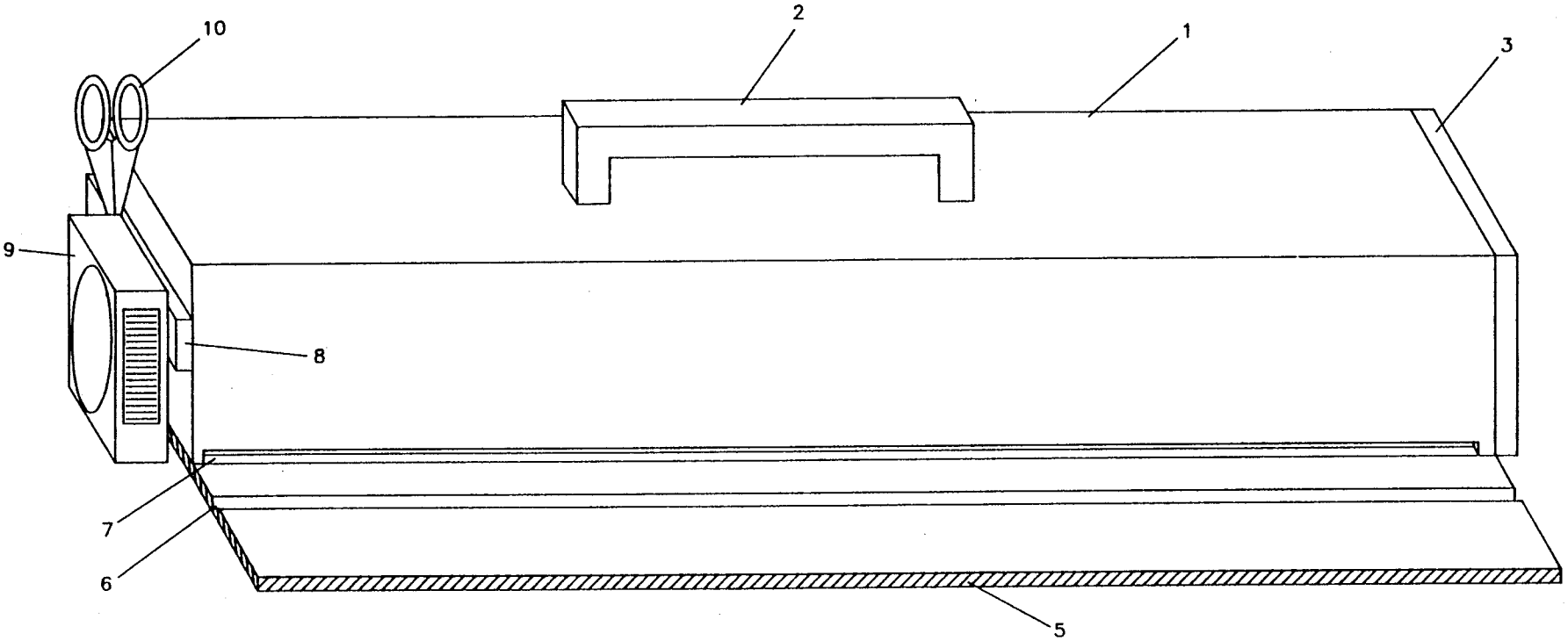
FIG. 1 Is a top perspective view of the sheet plastic roll dispenser and measuring tool.
Figure 2:
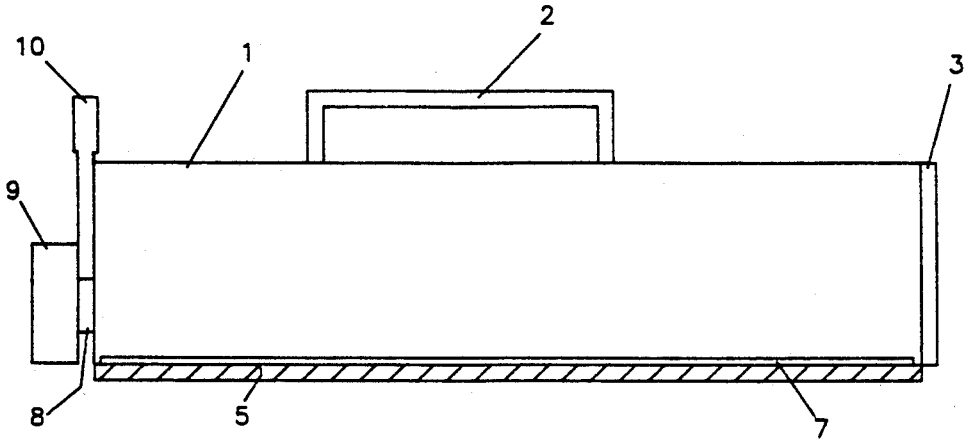
FIG. 2 Is a front elevational view thereof.
Figure 3:
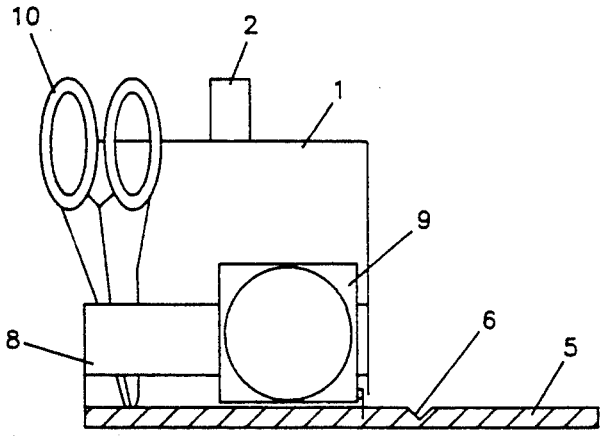
FIG. 3 Is a left-side elevational view thereof.
Figure 4:
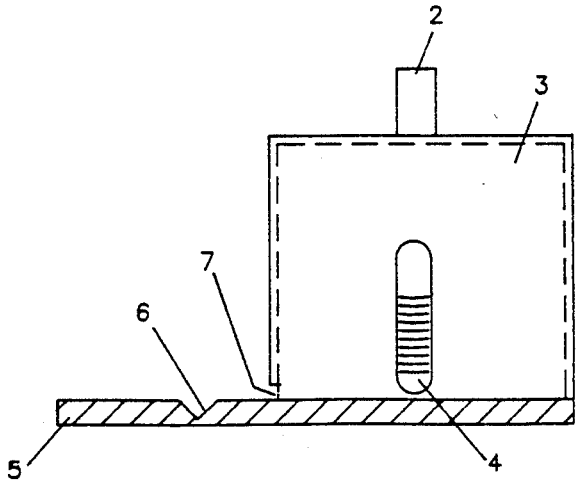
FIG. 4 Is a right-side elevational view thereof.
Figure 5:
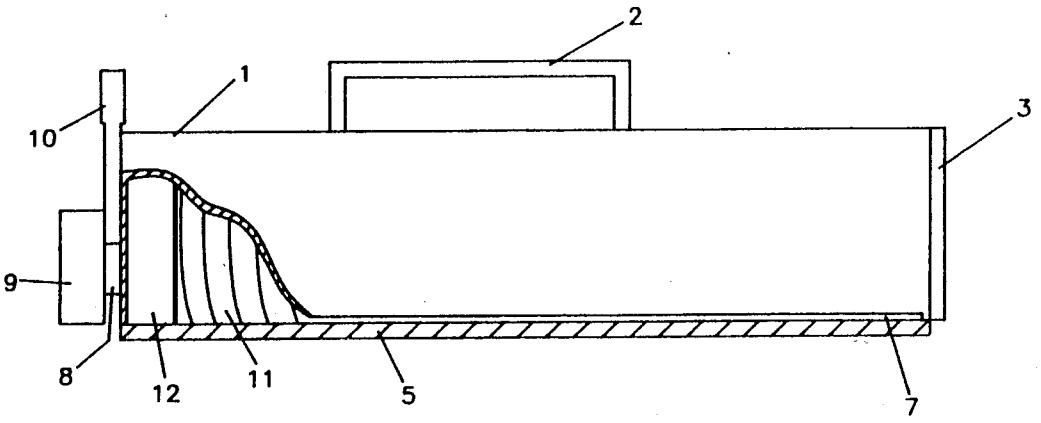
FIG. 5 Is a front elevational cut-away view thereof, illustrating the placement of sheet plastic roll goods, and spacer segment.
Figure 6:
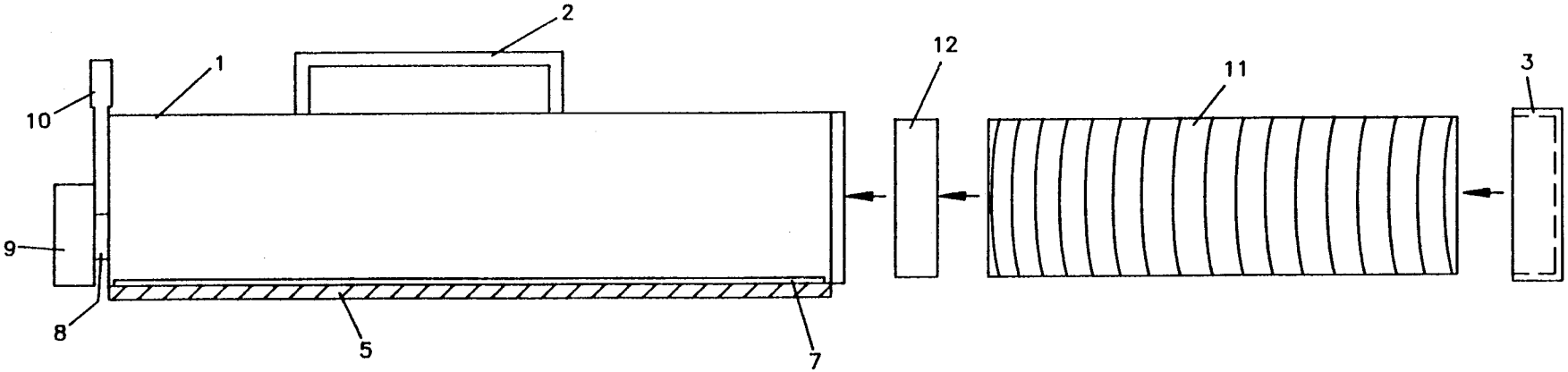
FIG. 6 Is an exploded front elevational view of the present invention.

The present invention comprises an improved appliance and dispensing container for plastic sheeting roll goods, and the casing 1, generally describes a hollow, rectangular magazine and is preferably constructed of press-formed sheet metal. However, an extruded plastic or metallic construction may be employed. The preferred dimensions of the casing 1 are; length, 41 inches, height and width, 6½ inches. A carrying handle 2 is permanently affixed to the topmost surface of the casing 1.

An end-cap 3, also of formed sheet metal construction, is removeably mounted to the right side of the casing 1. Preferably, the end cap 3 is held onto place on the casing 1 through an "interference fit" or "clamping action." A "sight gauge" 4 which is a slot through the fact of the end cap 3, provides for a view through the end cap 3 to inspect remaining roll goods volume.

A flat base plate 5 comprises the base of the casing 1. The base plate 5 extends and projects approximately 4 inches from the forward face of the casing 1, and the base plate 5 is preferably constructed of sheet metal having a substantial thickness. However, a rigid plastic having a substantial thickness may be employed. The flat base, plate 5 may be companion-formed the same time as while constructing the casing 1 or alternately, may be an add-on after press-forming, (example: spot-welded or mechanical fasteners.)

The flat base plate 5 is provided with a knife/scissor guide groove 6 which comprises a "v" shaped groove in the upper surface of the flat base plate 5. The knife/scissors guide groove 6 resides approximately 3 inches beyond the forward face of the casing 1. The knife/scissor guide groove 6 is aligned with the length of the casing 1, and the knife/scissor guide groove 6 extends the entire length of the flat base plate 5. The knife/scissor guide groove 6 serves as a guide for straight-line. cutting of dispensed sheet plastic roll goods.

The casing 1 is provided with a pay-out slot 7, through which the plastic sheet roll goods are dispensed toward the knife scissor guide groove 6. The pay-out slot 7 extends substantially the length of the front face of the casing 1, and the pay-out slot 7 resides atop the flat base plate 5. The pay-out slot 7 communicates with the hollow interior of the casing 1, and provides a through passage for the movement of the sheet plastic roll goods. A bracket 8 permanently resides upon the left face of the casing 1. The bracket 8 is constructed of press-formed sheetmetal, and is permanently attached to the left face of the casing 1. The bracket 8 serves as both a temporary storage (pocket) area for the scissors 10, and as a retainer for the spring clip on the tape measure to hold the tape measure 9 in place. To this end, the tape measure 9 is removable from the bracket 8, for useability in other areas, as needed. The scissors 10 are also removable from the bracket 8, to allow use in cutting sheet plastic dispensed from the pay-out slot 7, or other cutting uses. Additionally, the bracket 8 is appropriately sized to enable it to hold scissors 10 (as illustrated in the drawings) or will allow for holding a common construction utility knife in place of the scissors 10. A roll of plastic sheeting material 11 removably resides inside the hollow of the casing 1. The roll of plastic sheeting may be supplied in various diameters, or various lengths, or both. To accommodate for the varying dimensions of supplied plastic sheeting roll goods, a removable cylindrical spacer 12 is provided to reside adjacent to the shorter length roll good 11 material once the roll 11 resides inside the hollow of the casing 1. The cylindrical spacer is not utilized with the longer length plastic sheeting roll goods.

Based on the foregoing text, I wish it to be understood that this description of the present invention is done to fully comply with disclosure requirements, and is not intended to limit the invention in any way. Various modifications, changes, additions or applications other than those specifically outlined herein will become readily apparent to those having skill in the art, without departing from the spirit of my invention, and may be considered to be within the scope and essence of my invention. Accordingly, it is desired that the scope and essence of my invention be determined, not entirely by the foregoing specification, and the embodiments depicted in the drawings, but rather be determined by the appended claims and their legal equivalents.

I hereby claim:

1. A combination carrier, dispenser and measuring appliance for use with plastic sheeting roll goods, comprising;

a rectangular bodied, hollow container, said hollow container providing a chamber to contain and dispense various sizes of plastic sheeting roll goods; and an exit slot in a front face of the hollow container, said exit slot extending substantially the length of the container to permit the plastic sheeting roll goods to be dispensed therethrough; and a carrying handle permanently affixed to an uppermost face of said container; and a flat, base plate, permanently affixed to a lowermost face of the container, said base plate extending perpendicularly and outwardly in a flat plane from the front face of the container; and a "V" shaped groove formed in an upper surface of said flat base plate, said groove being located parallel to and extending substantially the entire length of said rectangular, hollow container, and said groove being located downstream from the exit slot in a dispensing direction; and a removable closure cap, securable to the hollow container at one end thereof, said closure cap having a central slot perforation for viewing inside the container; and a cylindrical spacer, removably positioned inside said hollow container; and a tape measure removably mounted to a permanent bracket attached to an end face of said hollow container opposite to the end at which the closure cap is secured; and a cutting tool removably mounted to the permanent bracket.

2. A combination carrier, dispenser and measuring appliance as recited in claim 1, wherein said container is constructed of extruded material.

* * * * *